US011415913B2

(12) United States Patent
Kasai et al.

(10) Patent No.: US 11,415,913 B2
(45) Date of Patent: Aug. 16, 2022

(54) ELECTROPHOTOGRAPHIC MEMBER AND ELECTROPHOTOGRAPHIC IMAGE FORMING APPARATUS

(71) Applicant: CANON KABUSHIKI KAISHA, Tokyo (JP)

(72) Inventors: Naoko Kasai, Kanagawa (JP); Toshio Tanaka, Kanagawa (JP); Yasutomo Tsuji, Tochigi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/327,139

(22) Filed: May 21, 2021

(65) Prior Publication Data

US 2021/0373463 A1 Dec. 2, 2021

(30) Foreign Application Priority Data

May 28, 2020 (JP) ..... JP2020-093114
Apr. 21, 2021 (JP) ..... JP2021-071938

(51) Int. Cl.
*G03G 15/16* (2006.01)
*G03G 15/01* (2006.01)
*G03G 21/16* (2006.01)

(52) U.S. Cl.
CPC ..... *G03G 15/162* (2013.01); *G03G 15/0189* (2013.01); *G03G 21/168* (2013.01); *G03G 2215/00059* (2013.01)

(58) Field of Classification Search
CPC ..... G03G 15/162; G03G 15/0189
See application file for complete search history.

(56) References Cited

U.S. PATENT DOCUMENTS

| | | | |
|---|---|---|---|
| 4,427,753 | A | 1/1984 | Fujimura et al. |
| 4,610,942 | A | 9/1986 | Yashiki et al. |
| 5,158,847 | A | 10/1992 | Go et al. |
| 5,227,271 | A | 7/1993 | Kikuchi et al. |
| 5,284,729 | A | 2/1994 | Tanaka et al. |
| 5,415,962 | A | 5/1995 | Kanemaru et al. |
| 5,484,673 | A | 1/1996 | Kikuchi et al. |
| 5,543,473 | A | 8/1996 | Fuei et al. |
| 5,677,095 | A | 10/1997 | Kikuchi et al. |

(Continued)

FOREIGN PATENT DOCUMENTS

| | | | |
|---|---|---|---|
| JP | 2006-77132 | A | 3/2006 |
| JP | 2006-84707 | A | 3/2006 |

(Continued)

OTHER PUBLICATIONS

U.S. Appl. No. 17/465,376, Yohei Miyauchi, filed Sep. 2, 2021.

*Primary Examiner* — Walter L Lindsay, Jr.
*Assistant Examiner* — Andrew V Do
(74) *Attorney, Agent, or Firm* — Venable LLP

(57) ABSTRACT

An electrophotographic member comprises a base member and an elastic layer on the base member. The elastic layer contains a silicone rubber, an ionic electroconductive agent, and an inorganic particle, and the inorganic particle contains a hydroxide of at least one of magnesium or aluminum, and has a silicon atom on a surface thereof in an amount of 0.50 to 2.00 atomic %. An aqueous dispersion of which 5 mg of the inorganic particle is dispersed in 10 ml of water has a turbidity of 200 NTU or more and 1,240 NTU or less.

6 Claims, 2 Drawing Sheets

(56) References Cited

U.S. PATENT DOCUMENTS

| | | | | |
|---|---|---|---|---|
| 5,756,248 | A | 5/1998 | Tanaka et al. | |
| 5,912,098 | A | 6/1999 | Tanaka et al. | |
| 6,185,398 | B1 | 2/2001 | Tanaka et al. | |
| 6,818,368 | B2 | 11/2004 | Tanaka et al. | |
| 6,958,204 | B2 | 10/2005 | Tanaka et al. | |
| 6,991,881 | B2 | 1/2006 | Ogaki et al. | |
| 6,994,941 | B2 | 2/2006 | Tanaka et al. | |
| 7,001,699 | B2 | 2/2006 | Tanaka et al. | |
| 7,045,261 | B2 | 5/2006 | Tanaka et al. | |
| 9,423,727 | B2 | 8/2016 | Yoshida et al. | |
| 9,442,430 | B2 | 9/2016 | Hamana et al. | |
| 9,575,439 | B2 | 2/2017 | Tsuji | |
| 9,606,478 | B2 | 3/2017 | Tsuji | |
| 10,768,557 | B2 | 9/2020 | Okamoto et al. | |
| 2002/0168859 | A1* | 11/2002 | Ehara ..... | G03G 5/14704 438/694 |
| 2005/0208402 | A1 | 9/2005 | Tanaka et al. | |
| 2015/0370199 | A1 | 12/2015 | Kojima | |
| 2018/0136589 | A1 | 5/2018 | Sakamoto | |

FOREIGN PATENT DOCUMENTS

| | | | |
|---|---|---|---|
| JP | 2007-86498 | A | 4/2007 |
| JP | 2011-197660 | A | 10/2011 |
| JP | 2016-27389 | A | 2/2016 |
| JP | 2018-84815 | A | 5/2018 |

* cited by examiner

ELECTROPHOTOGRAPHIC MEMBER AND ELECTROPHOTOGRAPHIC IMAGE FORMING APPARATUS

BACKGROUND

The present disclosure relates to an electrophotographic member to be used in an electrophotographic image forming apparatus.

DESCRIPTION OF THE RELATED ART

In order to impart flame retardancy, heat resistance, mechanical strength, and the like to an elastic layer of an electrophotographic belt, such as an intermediate transfer belt, an inorganic particle may be incorporated into the elastic layer. In this case, from the viewpoint of improving secondary transferability, it is effective to uniformly disperse the inorganic particle in the elastic layer so as not to generate protrusions derived from the inorganic particle on a toner image carrying surface of the electrophotographic belt. Japanese Patent Application Laid-Open No. 2006-84707 discloses a transfer belt for an electrophotographic apparatus including an electroconductive elastic layer containing a silicone rubber. Japanese Patent Application Laid-Open No. 2006-84707 discloses that it is preferable to use carbon powder or an ionic electroconductive agent as electroconductivity imparting agent for making the elastic layer electroconductive.

Further, Japanese Patent Application Laid-Open No. 2006-84707 discloses that it is preferable to blend an inorganic particle into a rubber layer forming the elastic layer in order to impart flame retardancy, heat resistance, mechanical strength, and the like to the elastic layer. Furthermore, Japanese Patent Application Laid-Open No. 2006-84707 discloses that, when the surface of each of the inorganic particle is treated with a silane coupling agent, the inorganic particle has increased affinity with a rubber and can be easily mixed into the rubber layer more uniformly.

According to investigations by the inventors, as described in Japanese Patent Application Laid-Open No. 2006-84707, the use of the inorganic particle subjected to surface treatment with a silane coupling agent is effective for reducing the generation of the protrusions derived from the inorganic particle on an outer surface of the electrophotographic belt. However, when the inorganic particle subjected to surface treatment with a silane coupling agent is incorporated into the elastic layer containing the ionic electroconductive agent, there is case where the electroconductivity of the elastic layer is decreased.

SUMMARY

At least one aspect of the present disclosure is directed to providing an electrophotographic member including an elastic layer in which an inorganic particle is uniformly dispersed, and which is highly electro conductive. Further, at least one aspect of the present disclosure is directed to providing an electrophotographic image forming apparatus capable of forming a high-quality electrophotographic image.

According to at least one aspect of the present disclosure, there is provided an electrophotographic member comprising a base member and an elastic layer on the base member, the elastic layer containing a silicone rubber, an ionic electroconductive agent, and an inorganic particle, the inorganic particle containing a hydroxide of at least one of magnesium or aluminum, and the inorganic particle having a silicon atom on a surface thereof in an amount of 0.50 atomic % or more and 2.00 atomic % or less, and an aqueous dispersion of which 5 mg of the inorganic particle is dispersed in 10 ml of water having a turbidity of 200 NTU or more and 1,240 NTU or less.

According to at least one aspect of the present disclosure, there is provided an electrophotographic image forming apparatus including the above-mentioned electrophotographic member as an intermediate transfer member.

Further features of the present disclosure will become apparent from the following description of exemplary embodiments with reference to the attached drawings.

DESCRIPTION OF THE EMBODIMENTS

Figure 1:
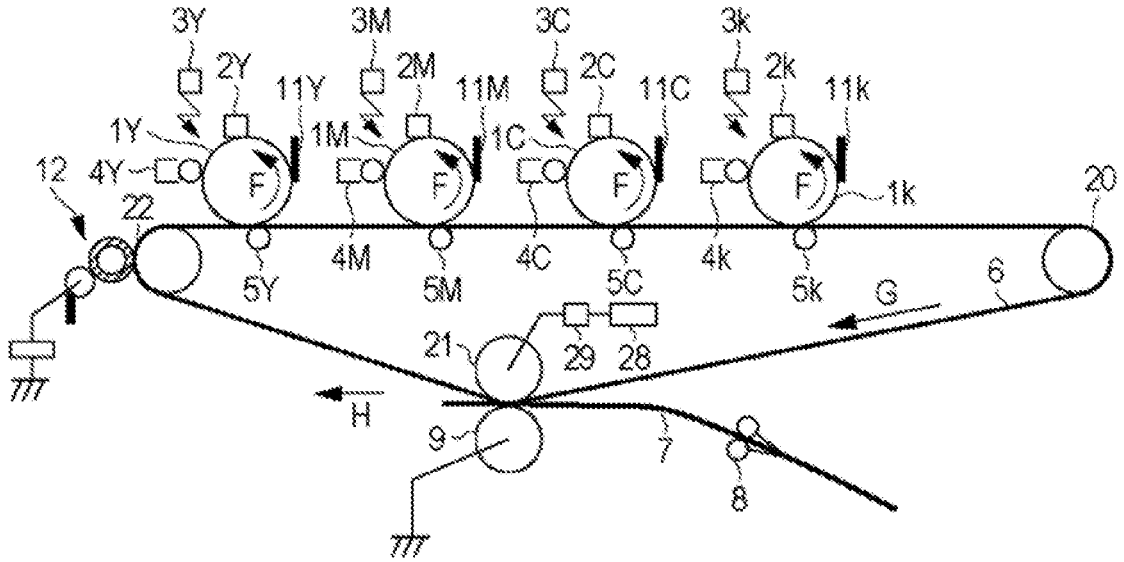
FIG. 1 is a schematic view of an electrophotographic image forming apparatus according to one aspect of the present disclosure.

Investigations made by the inventors have found that the use of an inorganic particle satisfying the following requirements i), ii) and iii) is effective for solving the above-mentioned flaw:

i) containing a hydroxide of at least one of magnesium or aluminum;

ii) having a silicon atom on a surface thereof in an amount of 0.50 atomic % or more and 2.00 atomic % or less;

iii) an aqueous dispersion of which 5 mg of the inorganic particle is dispersed in 10 ml of water has a turbidity of 200 NTU or more and 1,240 NTU or less.

The above-mentioned requirements ii) and iii) are each an indicator for indicating the degree of treatment with a silane coupling agent of a surface of the inorganic particle containing a hydroxide of at least one of magnesium or aluminum in the above-mentioned requirement i).

It is conceivable that the inorganic particle satisfying the above-mentioned requirements ii) and iii) improve the mobility of an ionic electroconductive agent due to the interaction between the ionic electroconductive agent and the hydrophilic group present on the surface of the inorganic particle in an elastic layer, to thereby impart higher electroconductivity to the elastic layer. That is, despite the fact that the ionic electroconductive agent is hardly dissociated in a silicone rubber, since the silicone rubber is non-polar compound, but the inorganic particle having a hydrophilic group and thereby satisfying the requirement iii) can accelerate the dissociation of the ionic electroconductive agent in the silicone rubber, and improve the mobility of the ionic electroconductive agent in the elastic layer.

In addition, it is conceivable that the affinity between the inorganic particle and the silicone rubber serving as a binder is increased due to the presence of a controlled amount of the silicon atom on the surface of the inorganic particle. Thus, the inorganic particle can be uniformly dispersed in the elastic layer, and thereby the generation of protrusions on the outer surface of an electrophotographic member derived from an agglomeration of inorganic particles can be effectively prevented.

[Curable Silicone Rubber Mixture]

The elastic layer according to one aspect of the present disclosure contains a silicone rubber, an ionic electroconductive agent, and an inorganic particle satisfying the above-mentioned requirements i) to iii). Such elastic layer may be formed of a cured product of a curable silicone rubber mixture containing a curable silicone rubber, an ionic electroconductive agent, and the inorganic particle satisfying the above-mentioned requirements i) to iii). Now, each component forming the curable silicone rubber mixture is described.

<Curable Silicone Rubber>

As the curable silicone rubber, an addition-curable liquid silicone rubber may be used. The addition-curable liquid silicone rubber contains the following components (a), (b), and (c):

(a) an organopolysiloxane having an unsaturated aliphatic group;

(b) an organopolysiloxane having active hydrogen bonded to a silicon atom; and (c) a platinum compound serving as a cross-linking catalyst.

Examples of the organopolysiloxane having an unsaturated aliphatic group serving as the component (a) include the following organopolysiloxanes:

such a linear organopolysiloxane that both terminals of a molecule thereof are each represented by $(R_1)_2R_2SiO_{1/2}$, and the intermediate units of the molecule are represented by $(R_1)_2SiO$ and $R_1R_2SiO$; and such a branched organopolysiloxane that the intermediate units of the molecule include $R_1SiO_{3/2}$ or $SiO_{4/2}$.

Herein, $R_1$ represents a monovalent, unsubstituted or substituted hydrocarbon group that is bonded to a silicon atom in the above-mentioned formula and is free of any unsaturated aliphatic group. Specific examples of the hydrocarbon group include the following groups:

an alkyl group (e.g., a methyl group, an ethyl group, a propyl group, a butyl group, a pentyl group, or a hexyl group); and an aryl group (e.g., a phenyl group or a naphthyl group).

Examples of a substituent that the hydrocarbon group may have include: halogen atoms, such as a fluorine atom and a chlorine atom; alkoxy groups, such as a methoxy group and an ethoxy group; and a cyano group. Specific examples of the substituted hydrocarbon group include a chloromethyl group, a 3-chloropropyl group, a 3,3,3-trifluoropropyl group, a 3-cyanopropyl group, and a 3-methoxypropyl group. Of those, it is preferred that 50% or more of $R_1$s represent methyl groups because the organopolysiloxane is easy to synthesize and handle, and excellent heat resistance is obtained, and it is more preferred that all $R_1$s represent methyl groups.

In addition, $R_2$ represents an unsaturated aliphatic group bonded to a silicon atom in the above-mentioned formula. Examples of the unsaturated aliphatic group include a vinyl group, an allyl group, a 3-butenyl group, a 4-pentenyl group, and a 5-hexenyl group. Of those, a vinyl group is preferred because the organopolysiloxane is easy to synthesize and handle, and the cross-linking reaction of the silicone rubber easily proceeds.

The organopolysiloxane having active hydrogen bonded to a silicon atom, which is the component (b), is a cross-linking agent that reacts with the unsaturated aliphatic group of the component (a) through the catalytic action of the platinum compound that is the component (c), to thereby form a cross-linked structure. The number of active hydrogen atoms bonded to the silicon atom in the component (b) is preferably more than three on average in one molecule.

As an organic group bonded to the silicon atom in the organopolysiloxane having active hydrogen bonded to a silicon atom, which is the component (b), there is given, for example, a monovalent, unsubstituted or substituted hydrocarbon group that is free of any unsaturated aliphatic group, which is the same as $R_1$ of the component (a). In particular, a methyl group is preferred as the organic group because the organopolysiloxane is easy to synthesize and handle. The molecular weight of the organopolysiloxane having active hydrogen bonded to a silicon atom is not particularly limited.

In addition, the viscosity of the component (b) at 25° C. is preferably 10 $mm^2/s$ or more and 100,000 $mm^2/s$ or less, more preferably 15 $mm^2/s$ or more and 1,000 $mm^2/s$ or less. When the viscosity of the organopolysiloxane at 25° C. falls within the above-mentioned ranges, the following situation is prevented: the component (b) is volatilized during storage, with the result that a desired cross-linking degree and physical properties of a molded product are not obtained. In addition, the organopolysiloxane becomes easy to synthesize and handle, and can be uniformly dispersed in a system.

A siloxane skeleton of the component (b) may be linear, branched, or cyclic, and a mixture thereof may be used. In particular, from the viewpoint of ease of synthesis, the linear siloxane skeleton is preferred. In addition, in the component (b), a Si—H bond may be present in any siloxane unit in the molecule, but it is preferred that at least a part thereof be present in a siloxane unit at the terminal of the molecule, such as an $(R_1)_2HSiO_{1/2}$ unit.

In the addition-curable liquid silicone rubber, the amount of the unsaturated aliphatic group is preferably 0.1 mol % or more and 2.0 mol % or less, more preferably 0.2 mol % or more and 1.0 mol % or less with respect to 1 mol of the silicon atom.

The hardness of the cured silicone rubber is preferably 5 degrees or more and 80 degrees or less, more preferably 15 degrees or more and 60 degrees or less in terms of type A hardness.

A known platinum compound may be used as the component (c).

<Inorganic Particle>

The inorganic particle satisfy the following requirements i) to iii): i) containing a hydroxide of at least one of magnesium or aluminum; ii) having a silicon atom on a surface thereof in an amount of 0.50 atomic % or more and 2.00 atomic % or less;

iii) an aqueous dispersion of which 5 mg of the inorganic particle is dispersed in 10 ml of water has a turbidity of 200 NTU or more and 1,240 NTU or less.

Through use of such an inorganic particle, the volume resistivity of the elastic layer can be adjusted within a medium range by the ionic electroconductive agent without generating the protrusions derived from the inorganic particle on a toner carrying surface of the electrophotographic member. Specifically, the volume resistivity of the elastic layer can be adjusted to, for example, within a medium range of from $1.0\times10^8$ Ω·cm to $2.0\times10^{11}$ Ω·cm. It can be recognized that the inorganic particle satisfies the above-mentioned requirements i) to iii), for example, by extracting a solid content from a curable silicone rubber mixture and subjecting the solid content to a combination of analysis with an X-ray photoelectron spectroscopic analyzer described later and turbidity measurement with a turbidimeter described later. When the silicone rubber mixture is a liquid, the silicone rubber mixture is diluted with a solvent such as toluene. When the silicone rubber mixture is a cured product, the silicone rubber mixture is dissolved with a solvent (for example, product name: eSolve 21RS, manufactured by Kaneko Chemical Co., Ltd.) capable of dissolving the cured product. Then, the resultant is filtered with a filter, thereby being capable of obtaining a solid content.

The above-mentioned requirement iii) is an indicator for indicating the degree of hydrophilicity of the inorganic particle. The turbidity may be obtained by measuring, with a turbidimeter, the turbidity of an aqueous dispersion prepared by adding 5 mg of the inorganic particle into 10 ml of water and stirring at 1,000 rpm for 10 minutes with a stirrer.

Herein, it is preferred that the inorganic particle be contained in an amount of 5.0 parts by mass or more and 30.0 parts by mass or less with respect to 100 parts by mass of the curable silicone rubber.

<<Magnesium Hydroxide Particle>>

Magnesium hydroxide particle is required to have appropriate hydrophobicity on the surface by silane coupling treatment in order to enhance the affinity with a silicone rubber, and are each required to have also appropriate hydrophilicity on the surface in order to assist the movement of the ionic electroconductive agent. The degrees of hydrophobicity and hydrophilicity of the magnesium hydroxide particle may be controlled by the degree of the silane coupling treatment.

The silane coupling treatment on the surface of the magnesium hydroxide particle may be performed by a known method, such as a wet treatment method, a dry treatment method, or an integral blend treatment method. In the curable silicone rubber mixture in this aspect, the silane coupling treatment of magnesium hydroxide particle was performed by a wet method. Specifically, the silane coupling treatment of magnesium hydroxide particle was performed by adding a silane coupling agent solution to an aqueous suspension of commercially available magnesium hydroxide particle (product name: KISUMA5, manufactured by Kyowa Chemical Industry Co., Ltd.) under stirring, filtering the mixture, and then drying the resultant by heating. The degree of the silane coupling treatment may be controlled by changing the addition amount of the silane coupling agent with respect to the weight of magnesium hydroxide. The silane coupling agent to be used herein is not particularly limited, for example, as long as the silane coupling agent can be used for treatment of hydrophobizing or hydrophilizing the surface of magnesium hydroxide. Examples thereof include vinyltrimethoxysilane, vinyltriethoxysilane, 3-methacryloxypropyltriethoxysilane, 3-methacryloxypropyltrimethoxysilane, 3-methacryloxypropylmethyldiethoxysilane, and 3-acryloxypropyltrimethoxysilane.

The degrees of hydrophobicity on the surface of magnesium hydroxide particle may be evaluated through use of an X-ray photoelectron spectroscopy. Specifically, the hydrophobicity may be evaluated by performing elemental analysis of the surface of each of magnesium hydroxide particle with an X-ray photoelectron spectroscopic analyzer (product name: QuanteraII, manufactured by ULVAC-PHI, Incorporated) and calculating an atomic ratio of a silicon atom based on the spectral data. In the curable silicone rubber mixture in this aspect, the atomic ratio of the silicon atom on the surface is preferably 0.50 atomic % or more and 2.00 atomic % or less, preferably 0.50 atomic % or more and 1.00 atomic % or less.

The degree of hydrophilicity on the surface of each of magnesium hydroxide particle may be evaluated by measuring turbidity. Specifically, the hydrophilicity may be evaluated by measuring turbidity of an aqueous dispersion prepared by adding 5 mg of magnesium hydroxide particle into 10 ml of water, and stirring at 1,000 rpm for 10 minutes with a stirrer, with a turbidimeter (product name: Lacom Tester Turbidimeter TN100IR, manufactured by AS ONE Corporation). Magnesium hydroxide particle having high hydrophilicity has superior dispersibility in water and hence has high turbidity. In the curable silicone rubber composition in this aspect, the turbidity is 200 NTU or more and 1,240 NTU or less, preferably 290 NTU or more and 1,200 NTU or less. NTU is an abbreviation for Nephelometric Turbidity Unit and indicates a unit of turbidity in a turbidimetric method.

<<Aluminum Hydroxide Particle>>

Similarly to the above-mentioned magnesium hydroxide particle, aluminum hydroxide particle are also required to have appropriate hydrophobicity and appropriate hydrophilicity, and the degrees of hydrophobicity and hydrophilicity may be controlled by the degree of silane coupling treatment.

The silane coupling treatment on the surface of the aluminum hydroxide particle may be performed in the same manner as in the magnesium hydroxide particle except that the magnesium hydroxide particle is changed to the aluminum hydroxide particle in the silane coupling treatment of the magnesium hydroxide particle.

The degrees of hydrophobicity and hydrophilicity on the surface of each of the aluminum hydroxide particle may be evaluated through use of a combination of X-ray photoelectron spectroscopy and turbidity measurement in the same manner as in the magnesium hydroxide particle. Specifically, evaluation may be made in the same manner as in the magnesium hydroxide particle except that the magnesium hydroxide particle is changed to the aluminum hydroxide particle in the X-ray photoelectron spectroscopy and turbidity measurement of magnesium hydroxide particle. Regarding the atomic ratio of a silicon atom on the surface, the aluminum hydroxide particle has a silicon atom preferably in an amount of 0.50 atomic % or more and 2.00 atomic % or less, more preferably in an amount of 0.50 atomic % or more and 1.00 atomic % or less. In the curable silicone rubber composition in this aspect, the turbidity is 200 NTU or more and 1,240 NTU or less, preferably 290 NTU or more and 1,200 NTU or less.

<Ionic Electroconductive Agent>

The ionic electroconductive agent is not particularly limited as long as the ionic electroconductive agent is a salt that can be dissociated into a cation (positive ion) and an anion (negative ion). However, in order to suppress fluctuation in conductivity caused by ambient humidity, a cation and an anion each having a hydrophobic structure are preferred. In addition, when the ionic electroconductive agent is an ion liquid having a melting point in the vicinity of room temperature, the ionic electroconductive agent can be easily added to and mixed into the curable silicone rubber. Further, it is more preferred that the ionic electroconductive agent be an ion liquid having a siloxane structure with high affinity with the curable silicone rubber because the ion liquid is uniformly dispersed in the curable silicone rubber.

As a specific example of the ion liquid, there is given, for example, an ion liquid formed of the following cation and a trifluoromethanesulfonylimide anion (hereinafter referred to as "TFSI⁻").

Structural Formula (1)

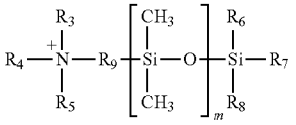

In the structural formula (1), $R_3$ to $R_5$ each independently represent a functional group, such as a linear or branched alkyl group having 1 to 10 carbon atoms, an alkoxy group having 1 to 10 carbon atoms, a hydroxyl group, a benzyl group, or a carboxyl group. Those functional groups may be directly bonded to a nitrogen atom of quaternary ammonium, or may be bonded to a nitrogen atom of quaternary ammonium via an alkyl group or the like. $R_3$ to $R_5$ preferably represent linear or branched alkyl groups each having 1 to 10 carbon atoms. $R_6$ to $R_5$ each independently represent a linear or branched alkyl group having 1 to 10 carbon atoms.

$R_9$ represents a linking group of a quaternary ammonium structure and a dimethylsiloxane chain. $R_9$ represents, for example, an alkylene group having 1 to 20 carbon atoms (which may be linear or branched) which may have a substituent. The alkylene group may have a structure via a group selected from -Ph- (phenylene), —O—, —C(=O)—, —C(=O)—O—, or —C(=O)—NR— (R represents an alkyl group having 1 to 6 carbon atoms). As the substituent of the alkylene group, there is given a hydroxyl group. The number of repetitions "m" of the dimethylsiloxane chain is an integer of 1 or more and 150 or less.

As a specific example of the cation, there is given, for example, a siloxane-modified cation as represented by the following structural formula (1-1).

Structural Formula (1-1)

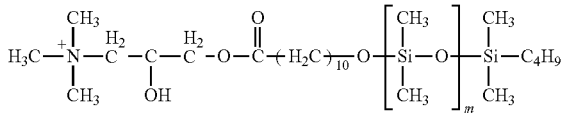

An ion liquid formed of the cation represented by the structural formula (1-1) and $TFSI^-$ (hereinafter sometimes referred to as "ion liquid No. 1") may be synthesized, for example, by coupling a glycidyl-modified quaternary ammonium salt and one-terminal carboxy-modified dimethyl siloxane to each other.

Specifically, through use of 3.97 parts by mass of a glycidyltrimethylammonium salt (product name: Modication GTA-IL, manufactured by Yokkaichi Chemical Co., Ltd., anion: $TFSI^-$), 18.0 parts by mass of one-terminal carboxy-modified polydimethylsiloxane (product name: MBR-B12, molecular weight=1,500, manufactured by Gelest, Inc.), and 0.1 part by mass of triethylamine (0.1 equivalent with respect to an ammonium salt) serving as a catalyst, anhydrous acetonitrile was added so that the total amount of the solution was 30 mL, and the mixture was allowed to react at a temperature of 80° C. for 10 hours. After completion of the reaction, the solvent was distilled off with an evaporator, and purification was performed through use of column chromatography (product name: silica gel 60N, 100 μm to 210 μm, manufactured by Kanto Chemical Co., Inc.). The developing solvent of the column is not particularly limited as long as a product is soluble and an R/F value on a thin layer chromatography (TLC) plate is appropriate, but for example, a mixed liquid of ethyl acetate and normal hexane may be used. Then, the solvent was removed with the evaporator to obtain siloxane-modified ion liquid No. 1.

<Additive>

In addition to the foregoing, the elastic layer may contain additives, such as a filler, a cross-linking accelerator, a cross-linking retarder, a cross-linking aid, a colorant, a scorch inhibitor, an antioxidant, a softening agent, a heat stabilizer, a flame retardant, a flame retardant aid, a UV absorber, and a rust preventive. However, when other inorganic particle is added, the surface thereof is also required to have a sufficient hydrophilic group so as not to impair the interaction between the ionic electroconductive agent and the hydroxyl group on the surface of each of the hydroxide particles.

[Electrophotographic Member]

Figure 2:
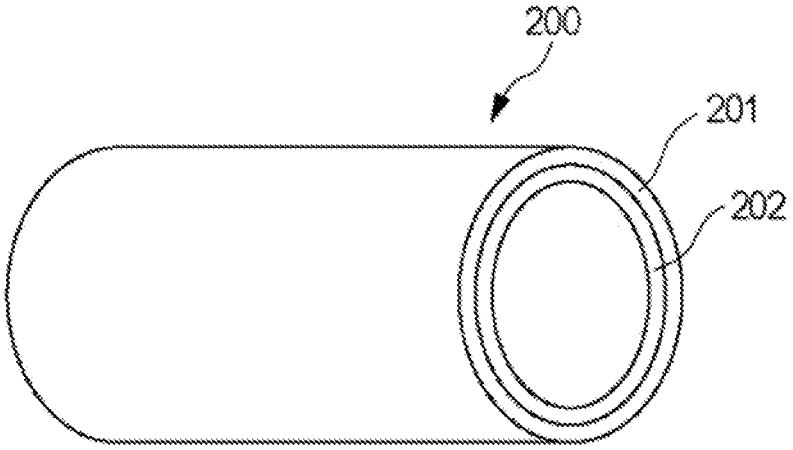
FIG. 2 is a schematic view of an electrophotographic member having an endless shape according to one aspect of the present disclosure.

Next, the electrophotographic member is described. FIG. 2 is a schematic view of an electrophotographic member (hereinafter sometimes referred to as "electrophotographic belt") 200 having an endless shape according to one aspect of the present disclosure. The electrophotographic belt 200 includes a base member 202 having an endless shape and an elastic layer 201 formed on the outer peripheral surface of the base member 202. As required, a surface layer (not shown) may be further formed on the outer peripheral surface of the elastic layer 201.

<Base Member>

As the base member, a base member having a cylindrical shape, a columnar shape, or an endless belt shape may be used in conformity with the shape of the electrophotographic member. A material for the base member is not particularly limited as long as the material is excellent in heat resistance and mechanical strength. Examples thereof include: metals, such as aluminum, iron, copper, and nickel; alloys, such as stainless steel and brass; and ceramics, such as alumina and silicon carbide. Examples thereof also include resins, such as polyether ether ketone, polyethylene terephthalate, polybutylene naphthalate, polyester, polyimide, polyamide, polyamide imide, polyacetal, and polyphenylene sulfide.

When a resin is used as the material for the base member, conductive powder, such as metal powder, conductive oxide powder, or conductive carbon, may be added to impart conductivity.

Resins having excellent flexibility and mechanical strength are particularly preferred as the material for the base member. Of those, polyether ether ketone containing carbon black as conductive powder and polyimide containing carbon black as conductive powder are particularly preferably used. In addition, the thickness of the base member having an endless shape is, for example, 10 μm or more and 500 μm or less, particularly 30 μm or more and 150 μm or less.

<Elastic Layer>

The elastic layer contains a cured product of the above-mentioned curable silicone rubber mixture.

The curable silicone rubber mixture is applied to and cured on the base member having a cylindrical shape, a columnar shape, or an endless belt shape, thereby being capable of forming an elastic layer on the base member. The thickness of the elastic layer may be appropriately adjusted within a range that satisfies the function as the electrophotographic member. In particular, the thickness of the elastic layer for an intermediate transfer belt is preferably from 80 μm to 600 μm, more preferably 150 μm or more and 400 μm or less from the viewpoints of the amount of compression deformation at the time of nipping and the suppression of color misregistration of a toner image on the surface of the intermediate transfer belt.

In order to bond the base member and the elastic layer to each other more firmly, a primer may be appropriately applied to the outer surface of the base member. The primer to be used herein is a paint in which a silane coupling agent, a silicone polymer, a hydrogenated methylsiloxane, an alkoxysilane, a reaction accelerating catalyst, and a colorant, such as red iron oxide, are appropriately blended and dispersed in an organic solvent. As the primer, a commercially available product may be used. The primer treatment is performed by applying the primer to the outer surface of the base member, followed by drying or calcination. The primer may be appropriately selected depending on the material for the base member, the kind of the elastic layer, or the mode of the cross-linking reaction. In particular, when the elastic layer contains a large amount of unsaturated aliphatic groups, a primer containing a hydrosilyl group is preferably used in order to impart adhesiveness through reaction with the unsaturated aliphatic groups. As a commercially available primer having such characteristics, there is given DY39-051A/B (product name, manufactured by Dow Corning Toray Co., Ltd.). On the contrary, when the elastic layer contains a large amount of hydrosilyl groups, a primer containing an unsaturated aliphatic group is preferably used. As a commercially available primer having such characteristics, there is given DY39-067 (product name, manufactured by Dow Corning Toray Co., Ltd.). As the primer, in addition to the foregoing, there is also given a primer having an alkoxy group. In addition, when the surface of the base member is subjected to surface treatment, such as UV irradiation, the cross-linking reaction between the base member and the elastic layer can be assisted, and the adhesive force can be further strengthened. In addition, examples of the primer other than the above-mentioned primers include X-33-156-20, X-33-173A/B, and X-33-183A/B (all of which are product names, manufactured by Shin-Etsu Chemical Co., Ltd.), and DY39-90A/B, DY39-110A/B, DY39-125A/B, and DY39-200A/B (all of which are product names, manufactured by Dow Corning Toray Co., Ltd.).

<Surface Layer>

The surface layer of the electrophotographic member is required to have resistance to abrasion caused by rubbing against a recording medium, such as paper, or various abutment members, such as a drum, and to have a low adhesion property so that a toner or the like does not stick to the surface layer. The resin to be used for the surface layer is not particularly limited as long as the resin has a low adhesion property, and examples thereof include a fluororesin, a fluorine-containing urethane resin, a fluororubber, and siloxane-modified polyimide. Of those, as the surface layer for the intermediate transfer belt, the fluorine-containing urethane resin is preferred from the viewpoint of not impairing the elastic function of the elastic layer.

The thickness of the surface layer is preferably 0.5 μm or more and 20 μm or less, more preferably 1 μm or more and 10 μm or less. When the thickness of the surface layer is 0.5 μm or more, the loss of a toner caused by the abrasion of the surface layer in association with the use can be easily suppressed. In addition, when the thickness of the surface layer is 20 μm or less, the elastic function of the elastic layer is not impaired.

The surface layer may contain the above-mentioned conductive powder as required. The content of the conductive powder in the surface layer is preferably 30 parts by mass or less with respect to the surface layer from the viewpoints of the adhesion property and mechanical strength.

In addition, as required, a primer layer may be formed between the elastic layer and the surface layer. The thickness of the primer layer is preferably 0.1 μm or more and 15 μm or less, more preferably 0.5 μm or more and 10 μm or less from the viewpoint of not impairing the elastic function.

[Electrophotographic Image Forming Apparatus]

An electrophotographic image forming apparatus according to one aspect of the present disclosure includes the above-mentioned electrophotographic endless belt according to this aspect as an intermediate transfer member (intermediate transfer belt). The electrophotographic image forming apparatus according to the one aspect of the present disclosure is described with reference to FIG. 1. The image forming apparatus according to this aspect has a so-called tandem type configuration in which image forming stations of a plurality of colors are arranged side by side in a rotating direction of an electrophotographic endless belt (hereinafter referred to as "intermediate transfer belt"). In the following description, the reference symbols of the configurations for respective colors of yellow, magenta, cyan, and black have suffixes Y, M, C, and k, respectively, but the suffixes may be omitted for the same configuration.

In FIG. 1, there are illustrated photosensitive drums (photosensitive members, image bearing members) 1Y, 1M, 1C, and 1*k*, and charging devices 2Y, 2M, 2C, and 2*k*, exposing devices 3Y, 3M, 3C, and 3*k*, developing devices 4Y, 4M, 4C, and 4*k*, and an intermediate transfer belt (intermediate transfer body) 6 are arranged on the periphery of the photosensitive drum 1. The photosensitive drum 1 is driven to rotate at a predetermined peripheral speed (process speed) in a direction of the arrow F. The charging device 2 is configured to charge the peripheral surface of the photosensitive drum 1 to a predetermined polarity and potential (primary charging). A laser beam scanner serving as the exposing device 3 is configured to output laser light that has been on/off-modulated in response to image information input from an external device, such as an image scanner or a computer (not shown), and to subject a charging treatment surface on the photosensitive drum 1 to scanning exposure. Through the scanning exposure, an electrostatic latent image corresponding to target image information is formed on the surface of the photosensitive drum 1.

The developing devices 4Y, 4M, 4C, and 4*k* are configured to accommodate toners of respective color components of yellow (Y), magenta (M), cyan (C), and black (k), respectively. Then, the developing device 4 to be used is selected based on the image information, and a developer (toner) is developed on the surface of the photosensitive drum 1, with the result that the electrostatic latent image is visualized as a toner image. In this embodiment, there is used a reversal development system involving causing a toner to adhere to an exposed portion of the electrostatic latent image to develop the toner. In addition, the charging device, the exposing device, and the developing device form an image forming unit.

In addition, the intermediate transfer belt 6 is the electrophotographic endless belt according to this aspect, and is arranged so as to be brought into abutment with the surface of the photosensitive drum 1 and tensioned on a plurality of tension rollers 20, 21, and 22. Then, the intermediate transfer belt 6 is configured to rotate in a direction of the arrow G. In this embodiment, the tension roller 20 is a tension roller configured to control the tension of the intermediate transfer belt 6 to be constant, the tension roller 22 is a drive roller for the intermediate transfer belt 6, and the tension roller 21 is a secondary transfer opposing roller. In addition, primary transfer rollers 5Y, 5M, 5C, and 5*k* are respectively arranged at primary transfer positions facing the photosensitive drum 1 with the intermediate transfer belt 6 interposed therebetween. Unfixed toner images of respective colors respectively formed on the photosensitive drum 1 are primarily transferred onto the intermediate transfer belt 6 sequentially and electrostatically by applying a primary transfer bias having a polarity (for example, a positive polarity) opposite to the charging polarity of the toner to the primary transfer roller 5 by a constant voltage source or a constant current source. Then, a full-color image in which the unfixed toner images of four colors are superimposed on the intermediate transfer belt 6 is obtained. The intermediate transfer belt 6 is configured to rotate while carrying the toner images transferred from the photosensitive drum 1 as described above. After each rotation of the photosensitive drum 1 from the primary transfer, the surface of the photosensitive drum 1 is cleaned by a cleaning device 11 to remove a transfer residual toner, and the image-forming process is repeated.

In addition, at a secondary transfer position of the intermediate transfer belt 6 facing a conveyance path of a recording material 7, a secondary transfer roller (transfer portion) 9 is arranged in pressure contact with the intermediate transfer belt 6 on a toner image carrying surface side. In addition, on a back surface side of the intermediate transfer belt 6 at the secondary transfer position, there is arranged the tension roller (opposing roller) 21 which forms a counter electrode of the secondary transfer roller 9 and receives a bias. When the toner image on the intermediate transfer belt 6 is transferred onto the recording material 7, a bias having the same polarity as that of the toner is applied to the opposing roller 21 by a transfer bias application unit 28, and for example, a voltage of from −1,000 V to −3,000 V is applied to cause a current of from −10 μA to −50 μA to flow. The transfer voltage in this case is detected by a transfer voltage detection unit 29. Further, a cleaning device (belt cleaner) 12 configured to remove the toner remaining on the intermediate transfer belt 6 after the secondary transfer is provided on a downstream side of the secondary transfer position.

The recording material 7 introduced into the secondary transfer position is held and conveyed at the secondary transfer position. In this case, a constant voltage bias (transfer bias) controlled to a predetermined bias is applied from the secondary transfer bias application unit 28 to the opposing roller 21 of the secondary transfer roller 9. Through application of the transfer bias having the same polarity as that of the toner to the opposing roller 21, a full-color image (toner image) of four colors superimposed on the intermediate transfer belt 6 is collectively transferred onto the recording material 7 in a transfer site, and a full-color unfixed toner image is formed on the recording material 7. The recording material 7 having the toner image transferred thereto is introduced into a fixing device (not shown), and the toner image is fixed by heating.

According to the one aspect of the present disclosure, the electrophotographic member including an elastic layer in which an inorganic filler is uniformly dispersed, and which has high conductivity can be obtained. In addition, according to the other aspect of the present disclosure, the electrophotographic image forming apparatus capable of forming a high-quality electrophotographic image can be obtained.

EXAMPLES

<Preparation of Magnesium Hydroxide Particle No. 1>

Magnesium hydroxide particle subjected to silane coupling treatment (hereinafter sometimes referred to as "magnesium hydroxide particle No. 1") was prepared as follows.

Magnesium hydroxide particle (product name: Kisuma5, manufactured by Kyowa Chemical Industry Co., Ltd.) was prepared as a raw material. 100 Parts by mass of water was added to 20 parts by mass of the magnesium hydroxide particle to prepare a suspension. The pH of the suspension was adjusted to 3.0 with acetic acid. 0.20 Part by mass of a silane coupling agent (product name: KBE-503, manufactured by Shin-Etsu Chemical Co., Ltd., 3-methacryloxypropyltriethoxysilane) was added dropwise to 100 parts by mass of the suspension, and the mixture was stirred at room temperature for 24 hours. Then, solid matter was filtered and dried at 80° C. for 24 hours to obtain magnesium hydroxide particle No. 1.

The silicon atomic weight on the surface and turbidity of the obtained magnesium hydroxide particle No. 1 were measured by the above-mentioned methods.

<Preparation of Magnesium Hydroxide Particle No. 2 to 5>

Magnesium hydroxide particle No. 2 to 5 were each prepared in the same manner as in the magnesium hydroxide particle No. 1 except that the amount of the silane coupling agent was changed as follows. The silicon atomic weight on the surface and turbidity of each of the obtained magnesium hydroxide particle No. 2 to 5 are shown in Table 1.

Magnesium hydroxide particle No. 2: 0.25 part by mass

Magnesium hydroxide particle No. 3: 0.18 part by mass

Magnesium hydroxide particle No. 4: 0.06 part by mass

Magnesium hydroxide particle No. 5: 0.60 part by mass

<Preparation of Aluminum Hydroxide Particle No. 1 and No. 2>

Aluminum hydroxide particle No. 1 and No. 2 were each prepared in the same manner as in the magnesium hydroxide particle No. 1 except that aluminum hydroxide particle (product name: Bf013, manufactured by Nippon Light Metal Co., Ltd.) was used as the aluminum hydroxide particle serving as a raw material, and the amount of the silane coupling agent was changed as follows. The silicon atomic weight on the surface and turbidity of each of the aluminum hydroxide particle No. 1 and No. 2 are shown in Table 1.

Aluminum hydroxide particle No. 1: 0.28 part by mass

Aluminum hydroxide particle No. 2: 0.42 part by mass

TABLE 1

| | Silicon atomic ratio on surface (atomic %) | Turbidity (NTU) |
|---|---|---|
| Magnesium hydroxide particle No. 1 | 0.58 | 1,126 |
| Magnesium hydroxide particle No. 2 | 0.72 | 292 |
| Magnesium hydroxide particle No. 3 | 0.51 | 1,235 |
| Magnesium hydroxide particle No. 4 | 0.19 | 627 |
| Magnesium hydroxide particle No. 5 | 1.13 | 28 |
| Aluminum hydroxide particle No. 1 | 0.81 | 350 |
| Aluminum hydroxide particle No. 2 | 1.20 | 225 |

Example 1

(Production of Base Member)

Materials shown in Table 2 below were each loaded into a twin-screw kneader (product name: PCM30, manufactured by Ikegai Corp.) through use of a weight feeder and kneaded to obtain a pellet. The cylinder set temperature of the twin-screw kneader was set to 320° C. in a material loading portion, and 360° C. in each of a portion on a downstream side of a cylinder and a die. The screw rotation number of the twin-screw kneader was set to 300 rpm, and the material supply amount was set to 8 kg/h.

TABLE 2

| Material | Blending amount (parts by mass) |
|---|---|
| Polyether ether ketone (product name: VICTREX PEEK 450G, manufactured by Victrex PLC) | 80 |
| Acetylene black (product name: Denka Black granular product, manufactured by Denka Company Limited) | 20 |

Then, the obtained pellet was subjected to cylindrical extrusion molding to produce a base member having an endless shape. The cylindrical extrusion molding was performed through use of a single-screw extruder (product name: GT40, manufactured by Research Laboratory of Plastics Technology Co., Ltd.) and a cylindrical die having a circular opening with a diameter of 300 mm and a gap of 1 mm.

Specifically, the pellet was supplied to the single-screw extruder in a supply amount of 4 kg/h through use of a weight feeder. The cylinder set temperature of the single-screw extruder was set to 320° C. in a material loading portion and 380° C. in each of a portion on a downstream side of a cylinder and a cylindrical die. The molten resin discharged from the single-screw extruder was extruded from the cylindrical die through a gear pump, and was taken up by a cylindrical take-up machine at such a speed that the thickness of the molten resin became 60 μm. In the process of being taken up, the molten resin was cooled and solidified by being brought into contact with a cooling mandrel provided between the cylindrical die and the cylindrical take-up machine. The solidified resin was cut to a width of 400 mm by a cylindrical cutting machine installed in a lower portion of the cylindrical take-up machine to obtain a base member having an endless shape.

(Preparation of Curable Silicone Rubber Mixture for Forming Elastic Layer)

As an ionic electroconductive agent, the above-mentioned ion liquid No. 1 was prepared.

The ion liquid No. 1 was synthesized by coupling a glycidyl-modified quaternary ammonium salt and a one-terminal carboxy-modified dimethylsiloxane to each other.

Specifically, through use of 3.97 g of a glycidyltrimethylammonium salt (product name: Modication GTA-IL, manufactured by Yokkaichi Chemical Co., Ltd., anion: $TFSI^-$), 18.0 g of one-terminal carboxy-modified polydimethylsiloxane (product name: MBR-B12, molecular weight=1,500, manufactured by Gelest, Inc.), and 0.1 g of triethylamine (0.1 equivalent with respect to an ammonium salt) serving as a catalyst, anhydrous acetonitrile was added so that the total amount of the solution was 30 mL, and the mixture was allowed to react at a temperature of 80° C. for 10 hours. After completion of the reaction, the solvent was distilled off with an evaporator, and purification was performed through use of column chromatography (product name: silica gel 60N, 100 μm to 210 manufactured by Kanto Chemical Co., Inc.).

As a developing solvent of the column, a solvent obtained by mixing ethyl acetate and normal hexane in an arbitrary ratio was used. After that, the solvent was removed with the evaporator to obtain the ion liquid No. 1 that was a siloxane-modified ion liquid.

Next, 2.0 parts by mass of the ion liquid No. 1 was added to 100 parts by mass of an addition-curable liquid silicone rubber (product name: TSE3450 A/B, manufactured by Momentive Performance Materials Inc.), followed by mixing.

Then, 5 parts by volume of the magnesium hydroxide particle No. 1 were added to 100 parts by volume of the silicone rubber. Further, 1.0 part by mass of a black silicone-based coloring material (product name: LEVI color 02, manufactured by Shin-Etsu Chemical Co., Ltd., containing 15 mass % to 20 mass % of carbon black) was added to the resultant, followed by stirring and defoaming through use of a planetary stirring defoaming device (product name: HM-500, manufactured by Keyence Corporation), to obtain an addition-curable liquid silicone rubber mixture.

Subsequently, after the outer surface of the base member was subjected to UV irradiation treatment, a primer (product name: DY39-051, manufactured by Dow Corning Toray Co., Ltd.) was applied to the base member and dried by heating.

The base member having a primer layer formed on the outer surface was mounted on a cylindrical core, and a ring nozzle for discharging a rubber was further mounted coaxially with the core. The addition-curable liquid silicone rubber mixture was supplied to the ring nozzle through use of a liquid feed pump and discharged from a slit, to thereby form a layer of the addition-curable liquid silicone rubber mixture on the base member. In this case, the relative moving speed and the discharge amount of the liquid feed pump were adjusted so that the elastic layer after curing had a thickness of 280 The resultant was placed in a heating furnace under a state of being mounted on the core and heated at 130° C. for 15 minutes and further at 180° C. for 60 minutes to cure the layer of the addition-curable liquid silicone rubber mixture, to thereby form an elastic layer.

(Preparation of Surface Layer)

A fluorine-containing polyurethane resin solution (product name: Emralon T-861, manufactured by Henkel Japan Ltd.) in which polytetrafluoroethylene (PTFE) particles were dispersed in a polyurethane dispersion liquid was prepared. Next, after the outer surface of the elastic layer was hydrophilized by irradiation with excimer UV, the elastic layer was fitted to the core. The fluorine-containing polyurethane resin solution was applied to the elastic layer through use of a spray gun (product name: W-101, manufactured by Anest Iwata Corporation) while the elastic layer was rotated at 200 rpm. After the application, the resultant was placed in a heating furnace at 130° C. and cured for 30 minutes. Thus, an electrophotographic belt No. 1 having the surface layer with a thickness of 3 μm on the elastic layer was obtained.

Examples 2 and 3

Electrophotographic belts No. 2 and 3 were each produced in the same manner as in Example 1 except that the addition amount of the magnesium hydroxide particle No. 1 was changed as shown in Table 3.

Examples 4, 5, and 7

Electrophotographic belts No. 4, 5, and 7 were each produced in the same manner as in Example 1 except that the magnesium hydroxide particle in the elastic layer and the addition amount thereof were changed as shown in Table 3.

Examples 6 and 8

Electrophotographic belts No. 6 and 8 were each produced in the same manner as in Example 2 except that the magnesium hydroxide particle in the elastic layer was changed to the aluminum hydroxide particle No. 1 or the aluminum hydroxide particle No. 2.

Comparative Examples 1 to 4

Electrophotographic belts No. 9 to 12 were each produced in the same manner as in Example 1 except that the magnesium hydroxide particle in the elastic layer and the blending amount thereof were changed as shown in Table 3.

The degree of protrusions derived from magnesium hydroxide particle or aluminum hydroxide particle in the elastic layer on the outer surface of the electrophotographic belt was measured through use of a confocal laser scanning microscope. The measurement results were evaluated based on the following criteria. The height of each of the protrusions was defined as a height difference between the center of the protrusion and a portion 1 mm away from the center of the protrusion from a shape profile obtained by the confocal laser scanning microscope.

TABLE 3

| | | | Ionic electroconductive agent | | Hydroxide | |
|---|---|---|---|---|---|---|
| | | Electrophotographic belt No. | Name | Blending amount (parts by mass) | Name | Addition amount (*parts by volume) |
| Example | 1 | 1 | Ion liquid No. 1 | 2.0 | Magnesium hydroxide particle No. 1 | 5.0 |
| | 2 | 2 | ditto | 2.0 | Magnesium hydroxide particle No. 1 | 10.0 |
| | 3 | 3 | ditto | 2.0 | Magnesium hydroxide particle No. 1 | 22.0 |
| | 4 | 4 | ditto | 2.0 | Magnesium hydroxide particle No. 2 | 10.0 |
| | 5 | 5 | ditto | 2.0 | Magnesium hydroxide particle No. 2 | 22.0 |
| | 6 | 6 | ditto | 2.0 | Aluminum hydroxide particle No. 1 | 10.0 |
| | 7 | 7 | ditto | 2.0 | Magnesium hydroxide particle No. 3 | 10.0 |
| | 8 | 8 | ditto | 2.0 | Aluminum hydroxide particle No. 2 | 10.0 |
| Comparative | 1 | 9 | ditto | 2.0 | Magnesium hydroxide particle No. 4 | 10.0 |
| Example | 2 | 10 | ditto | 2.0 | Magnesium hydroxide particle No. 5 | 10.0 |
| | 3 | 11 | ditto | 2.0 | Magnesium hydroxide particle No. 5 | 22.0 |
| | 4 | 12 | ditto | 4.0 | Magnesium hydroxide particle No. 5 | 22.0 |

*Addition amount with respect to 100 parts by volume of silicone rubber

<Evaluation>

In the electrographic belts No. 1 to 12, the burning time and volume resistivity were measured, and a protrusion rank was determined, as described below. In addition, image evaluation was made when each of the electrophotographic belts was used as an intermediate transfer belt to form an electrophotographic image. The results are shown in Table 4.

[Measurement of Volume Resistivity]

The value of volume resistivity was defined as an average value when measurement was performed at 58 points at intervals of 20 mm in a circumferential direction of a cylindrical electrophotographic belt having a peripheral length of 1,147 mm. The volume resistivity was measured by a double electrode method through use of a high resistivity meter (product name: Hiresta MCP-HT450, manufactured by Mitsubishi Chemical Analytic Co., Ltd.). The value at the time of application of 1,000 V/10 seconds through use of a UR probe was used. The volume resistivity was measured in an environment of 25° C. and 55% RH.

[Measurement of Burning Time]

The value of the burning time was measured as follows. A strip-like sample piece having a width of 50 mm and a length of 200 mm was cut out from an electrophotographic belt and rolled into a tubular shape so that the surface layer became an outer peripheral surface. Flame of a gas burner having a height adjusted to 20 mm was brought into contact with a lower end portion of the sample piece. The flame contact time was set to 3 seconds, and the period of time until the flame combustion of the sample piece after the flame contact was completed was measured. The same measurement was performed on five sample pieces, and the longest period of time was defined as the burning time.

[Evaluation of Protrusions on Outer Surface Derived from Magnesium hydroxide particle or Aluminum hydroxide particle in Elastic Layer]

Rank A: The height of the protrusion is 5 μm or less.

Rank B: The height of the protrusion is more than 5 μm and 20 μm or less.

Rank C: The height of the protrusion is more than 20 μm and 50 μm or less.

Rank D: The height of the protrusion is more than 50 μm.

[Image Evaluation]

Instead of an intermediate transfer belt mounted on a full-color electrophotographic image forming apparatus (product name: imagePRESS C800, manufactured by Canon Inc.), the electrophotographic belt of each of Examples or Comparative Examples was mounted as an intermediate transfer belt. Then, a solid image of a cyan color was output onto A4 size plain paper (product name: CS-680A4, manufactured by Canon Inc.). Cyan and magenta developers mounted on a print cartridge of the electrophotographic image forming apparatus were used to form the image. In addition, the image was output in an environment of normal temperature and normal humidity (temperature: 25° C., relative humidity: 55%). The full-color electrophotographic image forming apparatus includes a transfer roller in which a primary transfer unit is arranged so as to be opposed to an electrophotographic photosensitive member through intermediation of the intermediate transfer belt. A primary transfer voltage is from 1,000 V to 3,000 V, and a secondary transfer voltage is 1,000 V. The A4 size image was evaluated regarding whether or not image unevenness was observed and to which degree the image unevenness was observed if any based on the following criteria.

Rank A: No image unevenness is observed.

Rank B: Minor unevenness is partially recognized.

Rank C: Unevenness is recognized in a region of about 20% of the observed image.

Rank D: Unevenness is recognized over a half or more of the observed image.

TABLE 4

| | | Volume resistivity (Ω • cm) | Burning time (sec) | Protrusion evaluation rank | Image evaluation rank |
|---|---|---|---|---|---|
| Example | 1 | $4.0 \times 10^{10}$ | 27 | A | A |
| | 2 | $8.8 \times 10^{10}$ | 12 | A | A |
| | 3 | $3.6 \times 10^{10}$ | 8 | A | A |
| | 4 | $6.4 \times 10^{10}$ | 15 | A | A |
| | 5 | $5.3 \times 10^{10}$ | 10 | A | A |
| | 6 | $1.0 \times 10^{10}$ | 21 | A | A |
| | 7 | $3.9 \times 10^{10}$ | 13 | A | A |
| | 8 | $9.8 \times 10^{10}$ | 20 | A | B |
| Comparative Example | 1 | $2.8 \times 10^{10}$ | 26 | C | C |
| | 2 | $1.6 \times 10^{12}$ | 12 | A | C |
| | 3 | $5.2 \times 10^{12}$ | 9 | A | C |
| | 4 | $4.3 \times 10^{12}$ | 9 | A | C |

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-93114, filed May 28, 2020, and Japanese Patent Application No. 2021-071938, filed Apr. 21, 2021, which are hereby incorporated by reference herein in their entirety.

What is claimed is:

1. An electrophotographic member, comprising:

a base member; and an elastic layer on the base member, the elastic layer comprising a silicone rubber, an ionic electroconductive agent and an inorganic particle, wherein the inorganic particle contains at least one hydroxide of magnesium or aluminum, the inorganic particle has a silicon atom on a surface thereof in an amount of 0.50 to 2.00 atomic %, and when an aqueous dispersion of 5 mg of the inorganic particle and 10 ml of water is prepared, the aqueous dispersion has a turbidity of 200 to 1,240 NTU.

2. The electrophotographic member according to claim 1, wherein the elastic layer contains 5.0 to 30.0 parts by mass of the inorganic particle with respect to 100 parts by mass of the silicone rubber.

3. The electrophotographic member according to claim 1, wherein the aqueous dispersion has a turbidity of 290 to 1,200 NTU.

4. The electrophotographic member according to claim 1, wherein the electrophotographic member has a cylindrical or a columnar shape.

5. The electrophotographic member according to claim 1, wherein the electrophotographic member is an electrophotographic belt having an endless shape.

6. An electrophotographic image forming apparatus, comprising:

an electrophotographic member configured to function as an intermediate transfer member, the intermediate transfer member having a base member bearing an elastic layer, the elastic layer comprising a silicone rubber, an ionic electroconductive agent and an inorganic particle, wherein the inorganic particle contains at least one hydroxide of magnesium or aluminum, the inorganic particle has a silicon atom on a surface thereof in an amount of 0.50 to 2.00 atomic %, and when an aqueous dispersion of 5 mg of the inorganic particle and 10 ml of water is prepared, the aqueous dispersion has a turbidity of 200 to 1,240 NTU.

* * * * *